US005570509A

United States Patent [19]

Killian

[11] Patent Number: 5,570,509

[45] Date of Patent: Nov. 5, 1996

[54] NAIL CLIPPER WITH PIVOTING RETAINER STRUCTURE, IMPROVED HANDLING AND SIDE CUTTING JAWS

[76] Inventor: Patrick Killian, 1537A 4th St., Suite 8, San Rafael, Calif. 94901

[21] Appl. No.: 434,939

[22] Filed: May 4, 1995

[51] Int. Cl.[6] ..... A45D 29/02

[52] U.S. Cl. ..... 30/28; 30/125; 132/75.5

[58] Field of Search ..... 30/26, 27, 28, 30/29, 124, 125; 132/75.3, 75.4, 75.5; D28/60

[56] References Cited

U.S. PATENT DOCUMENTS

| | | | |
|---|---|---|---|
| 244,891 | 7/1881 | Heim et al. | 30/28 |
| 2,179,435 | 11/1939 | Smith | 30/28 |
| 2,774,138 | 12/1956 | Gowdey | 30/28 |
| 2,799,923 | 7/1957 | Senshu | 30/124 |
| 2,970,376 | 2/1961 | Kuo | 30/28 |
| 3,169,312 | 2/1965 | Fink | D28/60 |
| 4,860,448 | 8/1989 | Husain | 30/28 |

*Primary Examiner*—Hwei-Siu Payer

[57] ABSTRACT

A nail clipper incorporating a pivoting retainer structure which pivots from a cylindrical member disposed in the rear of the nail clipper is disclosed. The pivoting retainer structure retains nail clippings and facilitates the emptying of these clippings. In a closed position, the pivoting retainer structure nests into the body of the nail clipper. In an open position, the pivoting retainer structure pivots out from its nested position allowing the nail clippings to be emptied. In accordance with the present invention, the nail clipper further incorporates an ergonomically advantageous shape and side cutting jaws which guarantee that a small, discrete portion of the nail will be cut with each action of the nail clipper.

20 Claims, 12 Drawing Sheets

NAIL CLIPPER WITH PIVOTING RETAINER STRUCTURE, IMPROVED HANDLING AND SIDE CUTTING JAWS

BACKGROUND OF THE INVENTION

1. Field Of the Invention

The present invention relates to nail clippers such as fingernail clippers and toenail clippers.

2. Art Background

The function of nail clippers is to clip excessively long nails. A conventional nail clipper typically incorporates two opposing spring arms and a lever. Each of the spring arms terminates in a sharp cutting edge. The application of force to the lever causes these cutting edges to be brought together, and a nail placed between the cutting edges is thereby clipped.

The conventional nail clipper design, however, suffers from a number of shortcomings. First, the conventional nail clipper design fails to restrain nail clippings. As a result, nail clippings often disperse in unpredictable directions making clean up a problem. Second, the conventional nail clipper fails to cut the nail into a free piece with each action of the nail clipper. As a result, the user must often rotate the clipper along the edge of the nail, in a piecemeal fashion, until an awkwardly large piece is cut. Third, the conventional clipper design, in both its shape and weight distribution, typically fails to optimize handling and ease of operation.

A number of alternative designs have been proposed. In U.S. Pat. No. 4,776,090 (1988), for example, Grassi discloses a design utilizing a flexible cushioning member, a spring arm with a special opening, and a separate, plastic sleeve container which slides over the nail clipper. Unfortunately, in order to empty the Grassi nail clipper, the user must slide the sleeve free and clear of the nail clipper body. This sleeve can easily be lost or broken. Moreover, the necessary sliding motion down the full length of the clipper, with complete separation, is both clumsy and likely to eventually wear down the separate plastic sleeve. The design of the sleeve with a bottom recepticle also greatly increases the size of the clipper, thereby hampering its portability and ease of use. Lastly, the use of a flexible cushioning member and a spring arm with a special opening do not insure that the nail clippings will, in fact, pass into the bottom recepticle. Nail clippings may become lodged in the remaining space within the nail clipper body. As a result, two things, the nail clipper body and the bottom recepticle may have to be empied.

In U.S. Pat. No. 5,010,644 (1991), Goench describes a nail clipper incorporating a rigid retaining box permanently affixed to the bottom spring arm disposed around a rivet. The Goench design suffers from the fact that the retaining area is small, thereby necessitating frequent emptyings. Gaining access to clean the inside of the rigid retaining area is also very difficult. The Goench design additionally suffers from the fact that the user must empty the clippings from the front of the clipper. Accordingly, each and every nail clipping must pass through the narrow space between the rivet and the sides of the retaining box, as well as the narrow space between the cutting jaws in the front of the clipper. User frustration is likely.

Lastly, in U.S. Pat. No. 4,996,771 (1991), Williams discloses a design also utilizing a sliding sleeve for retaining nail clippings. The attachment of this sleeve to the nail clipper is disadvantageously complex. Bolts and sleeves with internally threaded bores and enlarged heads are used.

In addition, once the sleeve is attached, gaining access to clean the insides of the sleeve and nail clipper is cumbersome at best.

OBJECTS AND ADVANTAGES

Accordingly, several objects and advantages of the present invention are:

(a) to provide a nail clipper which advantageously retains nail clippings with each action of the nail clipper.

(b) to provide a nail clipper which additionally allows retained nail clippings to be emptied in an easy, controlled manner.

(c) to provide a nail clipper with a retaining structure that is durable and easily cleaned.

(d) to provide a nail clipper with a retaining structure which retains nail clippings in the inner cavity of the nail clipper.

(e) to provide a nail clipper which alternatively retains nail clippings in a container of satisfactory size and accessibility.

(f) to provide a nail clipper which is easy to hold.

(g) to provide a nail clipper which is easy to operate.

(h) to provide a nail clipper which cuts a small manageable free piece of the nail with each action of the nail clipper.

SUMMARY OF THE INVENTION

The nail clipper of the present invention incorporates a pivoting retainer structure which pivots from a cylindrical member disposed toward the rear of the nail clipper. The pivoting retainer structure is designed to retain nail clippings and facilitate the controlled emptying of these clippings. In a closed, retaining position, the pivoting retainer structure nests into the body of the nail clipper. In an open, emptying position, the pivoting retainer structure is drawn away from the body of the nail clipper, and the nail clippings are easily emptied.

In accordance with the present invention, the nail clipper further incorporates an ergonomically advantageous shape. In particular, the body and actuating lever of the nail clipper are teardrop in shape. The teardrop shape of the body results in greater ease of handling. The teardrop shape of the lever allows the thumb or finger to find a natural resting place when applying force to the lever. The nail clipper additionally incorporates side cutting jaws which cut a free section of the nail to be clipped with each action of the nail clipper.

BRIEF DESCRIPTION OF THE DRAWINGS

Further details are explained below with the help of the examples illustrated in the attached drawings in which.

DETAILED DESCRIPTION OF THE INVENTION

Figure 1A:
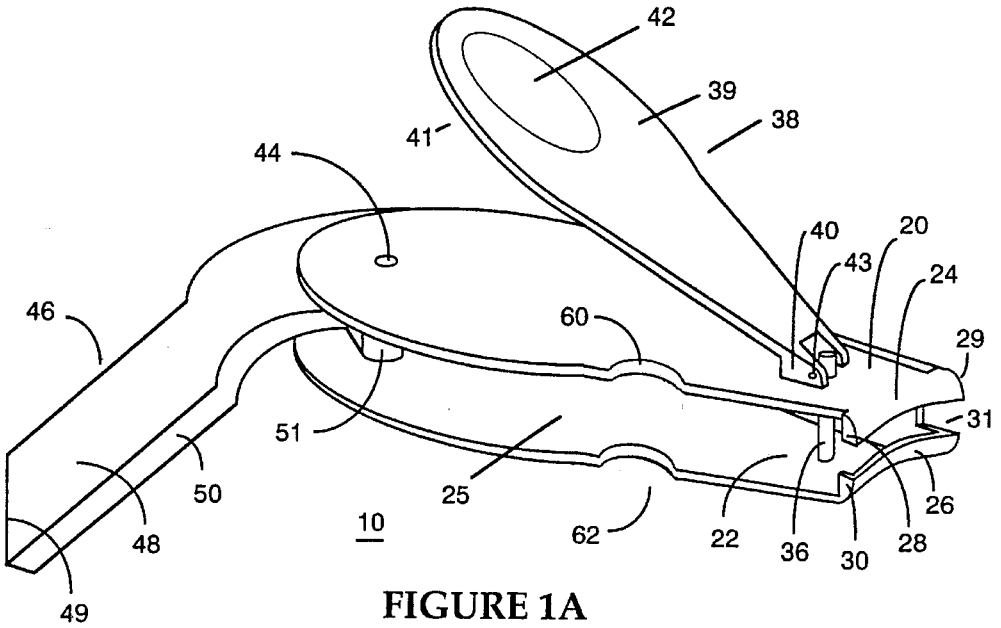
FIG. 1A is a perspective view of a first embodiment of the present invention with a pivoting retainer structure in an open position.

Referring now to FIG. 1A, this figure illustrates a first embodiment of the present invention. More particularly, FIG. 1A is a perspective view of the first embodiment in an open or emptying position. As shown, a nail clipper 10 incorporates an upper spring arm 20 and a lower spring arm 22. Upper spring arm 20 and lower spring arm 22 are coupled together at a first end with a cylindrical member 44. Cylindrical member 44 can take the form of a rivet which is substantially perpendicular to both upper spring arm 20 and lower spring arm 22 and pierces both spring arms. Alternatively, cylindrical member 44 could take the form of a cylindrical piece or grommet disposed between upper spring arm 20 and lower spring arm 22 such that neither spring arm is pierced (not shown). Upper spring arm 20 and lower spring arm 22 are advantageously disposed as illustrated such that an internal cavity 25 is formed between them.

Upper spring arm 20 and lower spring arm 22 are coupled together at a second end with a center anchor pin 36 which penetrates both spring arms. A lever member 38 is attached to center anchor pin 36 with a lateral connecting pin 43. Lever member 38 comprises a top working surface 39, a resting surface 41 (not visible in this figure) and an integral depending fulcrum 40. As will be appreciated, lever member 38 is used to actuate the nail clipper 10.

As illustrated in FIG. 1A, in accordance with the present invention, nail clipper 10 further incorporates a pivoting retainer structure 46. As will be described, pivoting retainer structure 46 provides for the retention of nail clippings within nail clipper 10. In particular, when pivoting retainer structure 46 is placed in a closed position, nail clippings are retained within nail clipper 10. Alternatively, when pivoting retainer structure 46 is placed in an open position such as is depicted in FIG. 1A, the user can empty the retained nail clippings.

As illustrated, pivoting retainer structure 46 comprises a side wall 48, a partial floor 50, an attachment sleeve 51, and a free end 49. Attachment sleeve 51 is used to attach pivoting retainer structure 46 to cylindrical member 44. In particular, cylindrical member 44 is threaded through attachment sleeve 51 such that attachment sleeve 51 is disposed around cylindrical member 44 and sandwiched between upper spring arm 20 and lower spring arm 22. The foregoing structure facilitates the pivoting of pivoting retainer structure 46 about cylindrical member 44. The free end 49 of pivoting retainer structure 46 can thereby be pivoted both towards and away from upper spring arm 20 and lower spring arm 22.

Continuing to refer to FIG. 1A, to provide a nail clipper 10 which is both easy to hold and operate, upper spring arm 20 and lower spring arm 22 are substantially teardrop in shape. Thus, focussing on upper spring arm 20 for explanatory purposes, upper spring arm 20 is comprised of a narrow front portion and an ovoid back portion. Lower spring arm 22 is similarly teardrop shaped, having a narrow front portion and an ovoid back portion.

Lever member 38 is similarly teardrop in shape. In particular, lever member 38 comprises a narrow front portion and an ovoid back portion. It will be appreciated that the wider, ovoid back portion provides an ergonomic advantage by allowing greater support to the full presence of the pressure of a thumb or finger on lever member 38. A dimple or depression 42 is disposed on the top working surface 39 within ovoid back portion. Dimple 42 further facilitates the steady application of force to lever member 38 and prevents the thumb or finger from slipping off lever member 38.

As shown in FIG. 1A, upper spring arm 20 terminates in an upper cutting jaw 24. Similarly, lower spring arm 22 terminates in a lower cutting jaw 26. Each of these cutting jaws terminates in a separate sharp cutting edge. In accordance with the present invention, nail clipper 10 further incorporates side cutting jaws. In particular, a first side cutting jaw 28 is disposed approximately perpendicular to upper cutting jaw 24 on a first side. A second side cutting jaw 29 (not visible in this figure) is also disposed approximately perpendicular to upper cutting jaw 24 on a second, opposite side. In a similar fashion, a third side cutting jaw 30 is disposed approximately perpendicular to lower cutting jaw 26 on a first side, while a fourth side cutting jaw 31 is disposed approximately perpendicular to lower cutting jaw 26 on the second side. Each one of the aforementioned side cutting jaws terminates in a separate sharp cutting edge.

Side cutting jaws 28, 29, 30, and 31 function advantageously to create a free nail piece with each action of the clipper. In particular, when a nail is cut with nail clipper 10, a small, discrete piece of the nail is clipped off with each action of the nail clipper. The clipper leaves the remaining portion of the nail with an approximate right angle cut where the small piece has been removed. By consistently producing a small, discrete free piece, the side cutting jaws also facilitate the collection and retention of nail clippings within the limited dimensions of the nail clipper. Conventional nail clippers, by way of contrast, often force the user to rotate the nail clipper along the radius of the nail, eventually producing an awkwardly large free piece.

Figure 1B:
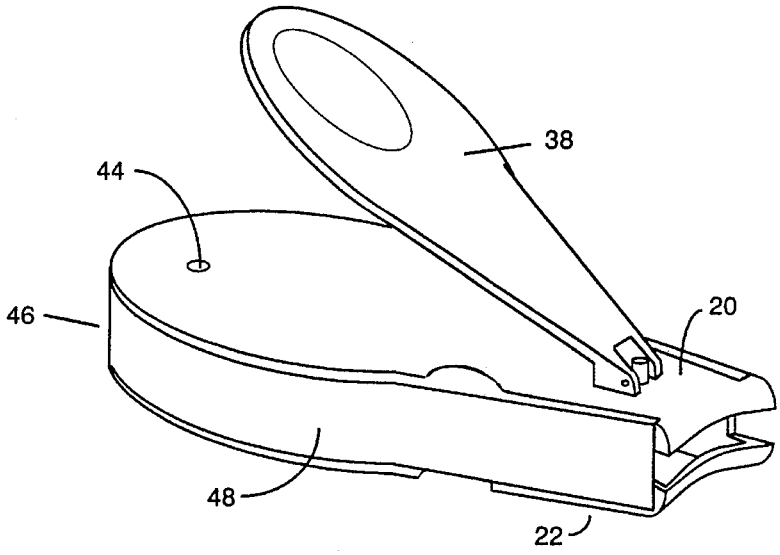
FIG. 1B is a perspective view of the first embodiment with the pivoting retainer structure closed.

Referring now to FIG. 1B, this figure illustrates a perspective view of the first embodiment with pivoting retainer structure 46 in a closed position. In particular, pivoting retainer structure 46 is nested against upper spring arm 20 and lower spring arm 22. Side wall 48 is advantageously shaped to correspond to the contours of the teardrop shape of upper spring arm 20 and lower spring arm 22.

Referring now to both FIGS. 1A and 1B, it will be appreciated that in order to bring the nail clipper from the open position depicted in FIG. 1A, to the closed position depicted in FIG. 1B, force is applied to pivoting retainer structure 46. In particular, force is applied such that pivoting retainer structure 46 pivots around cylindrical member 44, and free end 49 is brought toward upper spring arm 20 and lower spring arm 22. Eventually, as depicted in FIG. 1B, pivoting retainer structure 46 reaches the closed position where it nests against upper spring arm 20 and lower spring arm 22. With pivoting retainer structure in this closed position, nail clippings are retained within inner cavity 25.

Alternatively, to bring the nail clipper from the closed position shown in FIG. 1B to the open position shown in FIG. 1A, pivoting retainer structure 46 is pulled out, away from upper spring arm 20 and lower spring arm 22. To facilitate the initiation of this pulling action, an indent 60 is advantageously disposed upon upper spring arm 20. Indent 60 provides a small space between side wall 48 and upper spring arm 20. A thumb or an index finger, for example, can advantageously utilize this small space to initiate the requisite pulling action. A second indent 62 can optionally be disposed upon lower spring arm 22.

It should be understood that FIG. 1A depicts one of many positions wherein pivoting retainer structure 46 can be considered in an open position. Pivoting retainer structure 46 is opened in normal use to allow retained nail clippings to be emptied from inner cavity 25. The extent to which pivoting retainer structure 46 is opened is within the discretion of the user. The ability of pivoting retainer structure 46 to open wide facilitates the secure and easy cleaning of pivoting retainer structure 46.

Figure 1C:
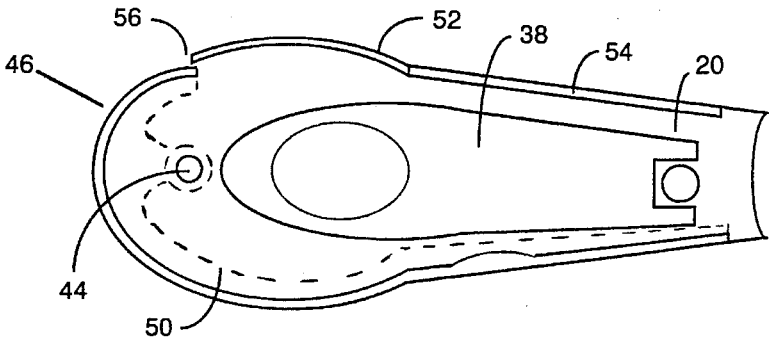
FIG. 1C is a top plan view of the first embodiment with the pivoting retainer structure closed.

Referring now to FIG. 1C, this figure illustrates a top view of the first embodiment with pivoting retainer structure 46 in the closed position. The dotted lines in this figure are included for illustrative purposes and depict the contours of pivoting retainer structure 46 nested within nail clipper 10. As shown, partial floor 50 is shaped to substantially correspond to the contours of the aforementioned teardrop shape of upper spring arm 20 and lower spring arm 22.

As shown in FIG. 1C, the pivoting retainer structure 46 essentially nests into one side of the nail clipper. On the other side of the nail clipper, are a stationary wall 52 and an active wall 54. Only the tops of stationary wall 52 and active wall 54 are visible in this figure. Pivoting retainer structure 46 and stationary wall 52 terminate in close proximity to one another, thereby defining a narrow insertion area 56. The narrow opening provided by narrow insertion area 56 allows pivoting retainer structure 46 to pivot from a closed position to an open position.

Figure 2A:
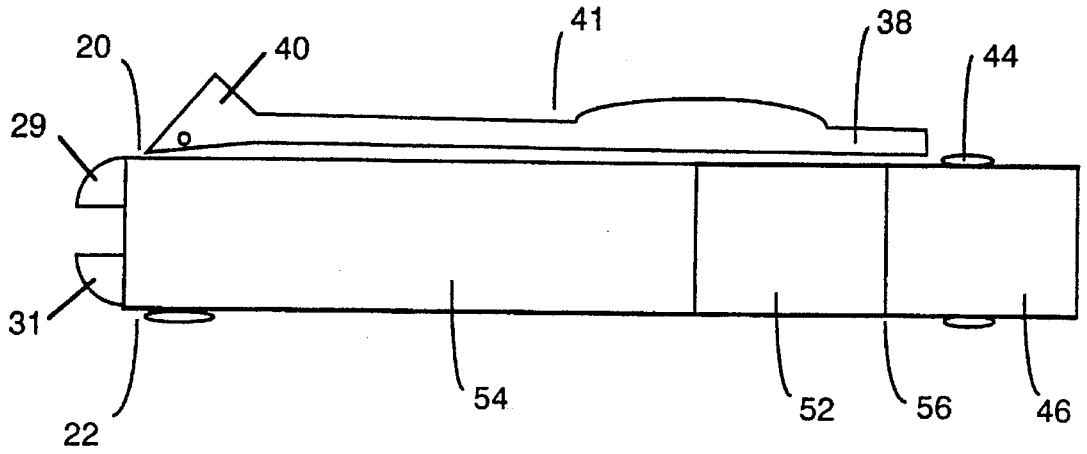
FIG. 2A is a side elevational view of the first embodiment with the lever in a resting position.

Turning now to FIG. 2A, this figure illustrates a side view of the nail clipper. In particular, this figure illustrates the side of the nail clipper incorporating stationary wall 52 and active wall 54. Both stationary wall 52 and active wall 54 are rigid walls. The top of stationary wall 52 is coupled to upper spring arm 20, and the bottom of stationary wall 52 is coupled to lower spring arm 22. It is, accordingly, fixed in place between upper spring arm 20 and lower spring arm 22. By way of contrast, only the bottom of active wall 54 is coupled to lower spring arm 22. The top of active wall 54 is not connected to upper spring arm 20. As will be described, this arrangement allows upper spring arm 20 to move freely alongside active wall 54 when the nail clipper is actuated.

Also visible in FIG. 2A is side cutting jaw 29 and side cutting jaw 31. Lever member 38 is shown in what can be considered a resting position, with integral depending fulcrum 40 facing upward. A back portion of pivoting retainer structure 46 and the narrow insertion space 56 are also visible.

Figure 2B:
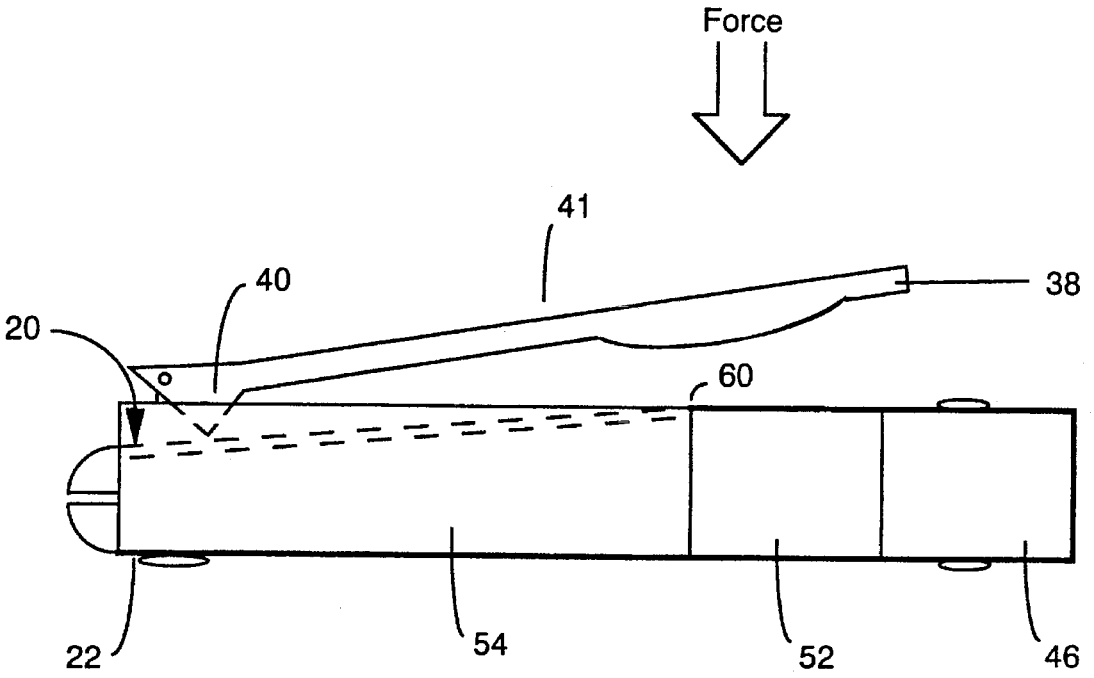
FIG. 2B is a side elevational view illustrating the result of applying force to the lever member.

Referring now to FIG. 2B, this figure illustrates a side view of the first embodiment when force is applied to lever member 38. For illustrative purposes, the outline of upper spring arm 20, situated behind active wall 54, is shown as a dotted line. As illustrated, downward force is applied to lever member 38 such that integral depending fulcrum 40 presses down upon upper spring arm 20. This downward pressure causes upper spring arm 20 to flex downward from flexing area 60. Thus, upper spring arm 20 flexes freely downward along active wall 54. Accordingly, active wall 54 allows upper spring arm 20 to flex freely, while nevertheless, serving as a wall to prevent clippings from leaving the internal cavity 25 (not shown in this figure).

Figure 3A:
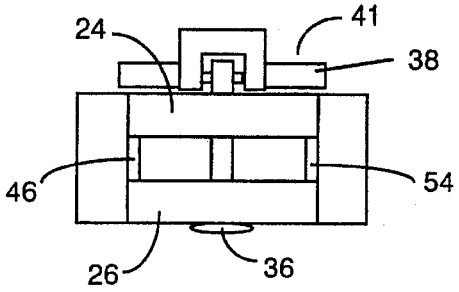
FIG. 3A is a front elevational view of the first embodiment.

Turning to FIG. 3A, this figure illustrates a frontal view of the nail clipper. Upper cutting jaw 24, lower cutting jaw 26, lever 38, resting surface 41, and center anchor pin 36 are noted. Portions of pivoting retainer structure 46 and active wall 54 are also visible in the gap between upper cutting jaw 24 and lower cutting jaw 26.

Figure 3B:
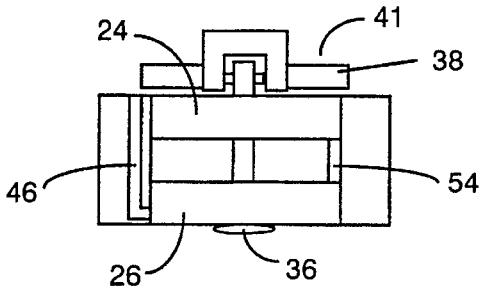
FIG. 3B is a front elevational view with the pivoting retaining structure slightly ajar.

FIG. 3B also illustrates a frontal view of the nail clipper with the pivoting retainer structure 46 slightly ajar. Upper cutting jaw 24, lower cutting jaw 26, lever 38, resting surface 41, and center anchor pin 36 are, again, noted.

Figure 3C:
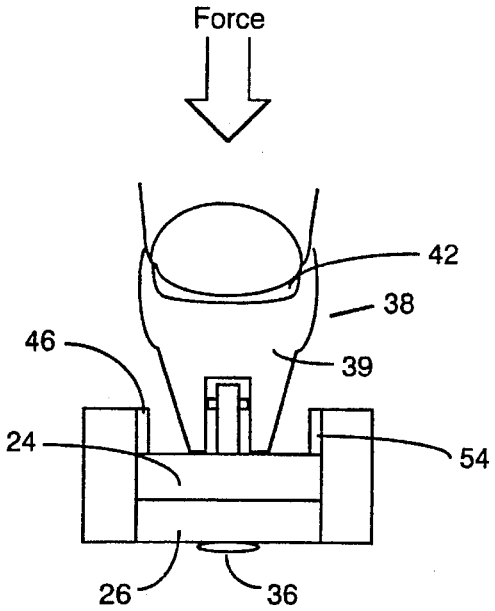
FIG. 3C is a front elevational illustrating the result of applying force to the lever member.

Referring now to FIG. 3C, a frontal view of the nail clipper illustrating the result of applying force to lever member 38 with a finger is shown. As shown, upper cutting jaw 24 has been forced down toward lower cutting jaw 26, exposing the upper portions of pivoting retainer structure 46 and active wall 54.

Figure 4A:
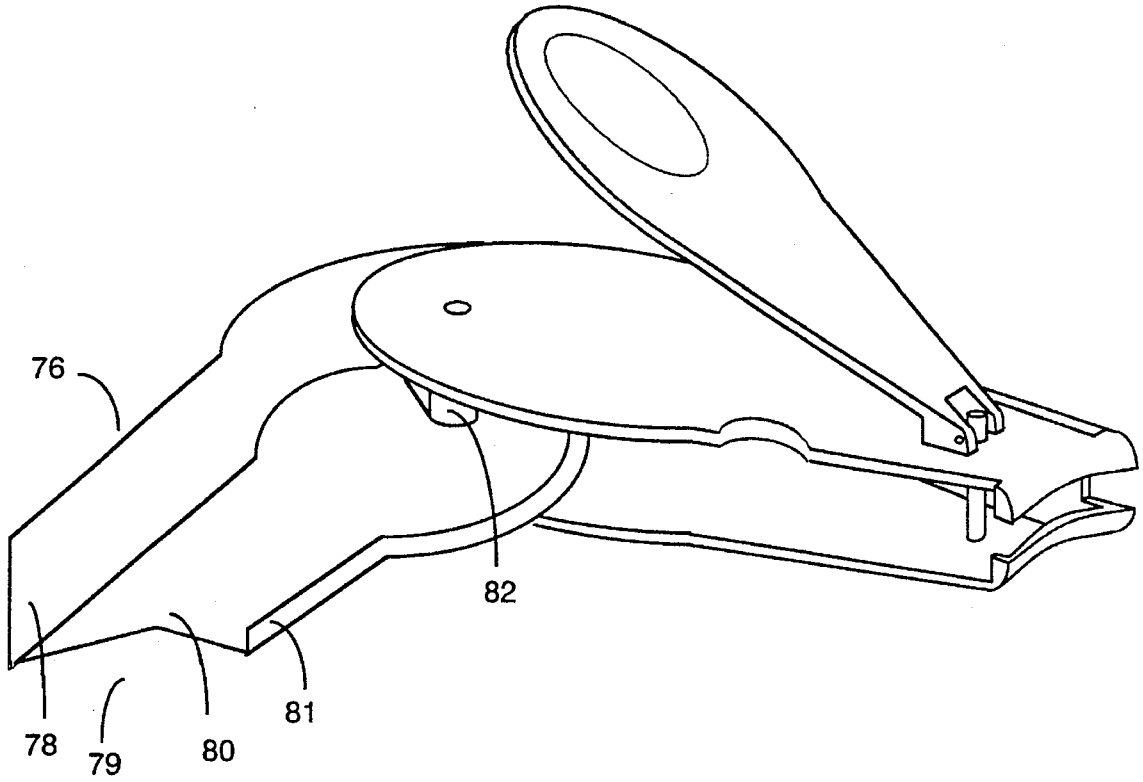
FIG. 4A is a perspective view of a second embodiment having a full tray structure.

Referring now to FIG. 4A, a second embodiment of the present invention is illustrated. As shown, the second embodiment incorporates a pivoting retainer structure 76 with a full tray structure. In particular, pivoting retainer structure 76 comprises a side wall 78, a free end 79, a full floor 80, a tray wall 81, and an attachment sleeve 82.

Figure 4B:
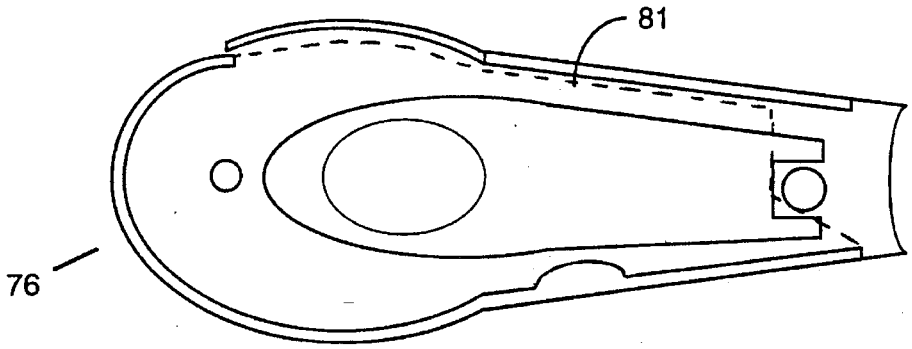
FIG. 4B is a top plan view of the the second embodiment.

With reference to FIG. 4B a top plan view of this embodiment is shown. The dotted lines depict the contours of pivoting retainer structure 76 within the nail clipper. It will be appreciatated from FIGS. 4A and 4B that the pivoting retainer structure 76 serves as an internal clippings container. Thus, when pivoting retainer structure 76 is in the closed position the nail clippings are held within the nail clipper. More particularly, though, the nail clippings are held within the confines of side wall 78, full floor 80 and tray wall 81 which function as an internal clippings container. Emptying the retained nail clippings from pivoting retainer structure 76 is particularly easy.

Figure 5A:
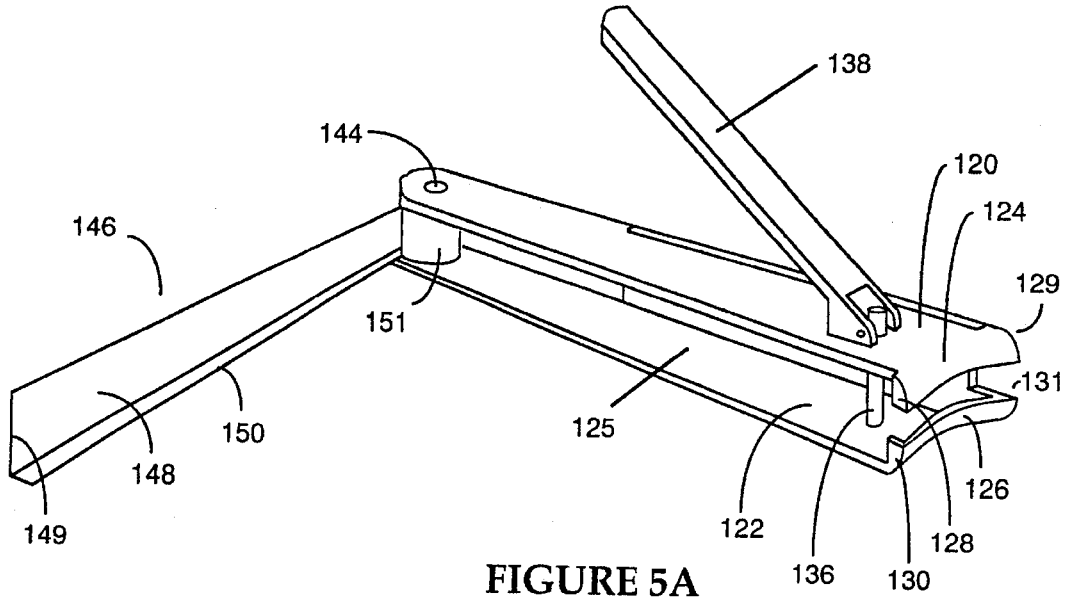
FIG. 5A is a perspective view of a third embodiment of the present invention with the pivoting retainer structure in an open position.

Turning now to FIG. 5A, a third embodiment of the present invention is illustrated. A nail clipper incorporates an upper spring arm 120 and a lower spring arm 122. Upper spring arm 120 and lower spring arm 122 are coupled together at a first end with a cylindrical member 144. Upper spring arm 120 and lower spring arm 122 are also disposed such that an internal cavity 125 is formed between them.

Upper spring arm 120 and lower spring arm 122 are coupled together at a second end with a center anchor pin 136 which penetrates both spring arms. A lever member 138 is attached to center anchor pin 136. In accordance with the present invention, the nail clipper also incorporates a pivoting retainer structure 146. As shown, pivoting retainer structure 146 comprises a side wall 148, a partial floor 150, an attachment sleeve 151, and a free end 149. The free end 149 of pivoting retainer structure 146 can thereby be pivoted both towards and away from upper spring arm 120 and lower spring arm 122.

As illustrated in FIG. 5A, upper spring arm 120 terminates in an upper cutting jaw 124. Similarly, lower spring arm 122 terminates in a lower cutting jaw 126. Each of these cutting jaws terminates in a separate sharp cutting edge. A first side cutting jaw 128 is disposed approximately perpendicular to upper cutting jaw 124 on a first side. A second side cutting jaw 129 (not visible in this figure) is also disposed approximately perpendicular to upper cutting jaw 124 on the opposite side. In a similar fashion, a third side cutting jaw 130 is disposed approximately perpendicular to lower cutting jaw 126 on a first side, while a fourth side cutting jaw 131 is disposed approximately perpendicular to lower cutting jaw 126 on the other side. Each one of these cutting jaws terminates in a separate sharp cutting edge.

Figure 5B:
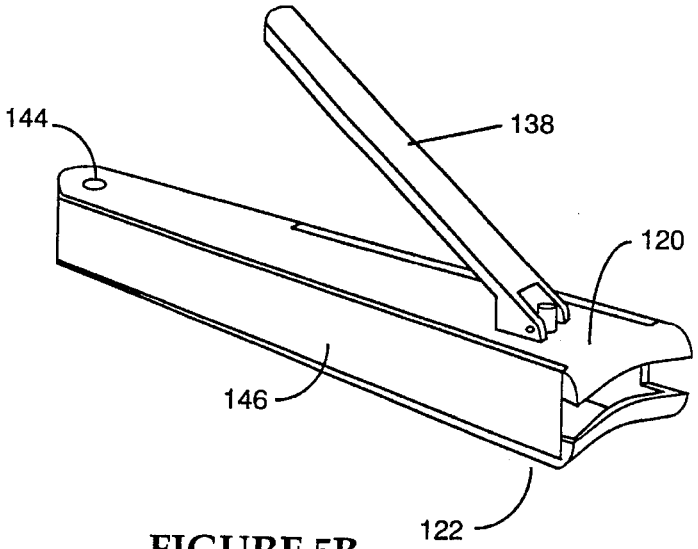
FIG. 5B is a perspective view of the third embodiment with the pivoting retainer structure closed.
Figure 5C:
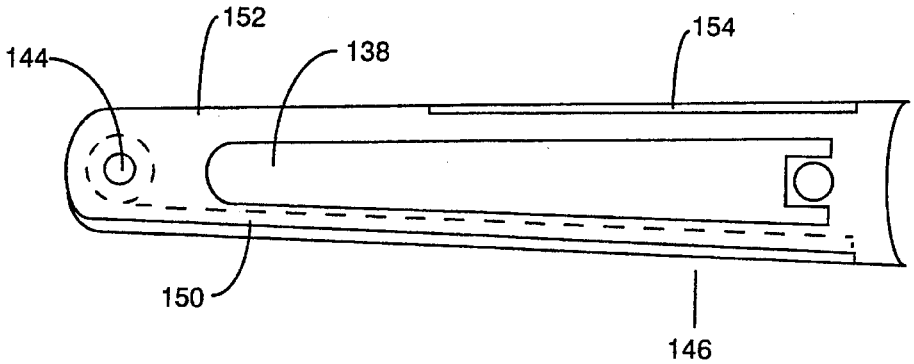
FIG. 5C is a top plan view of the third embodiment with the pivoting retainer structure closed.

Referring now to FIG. 5B, this figure illustrates the third embodiment with pivoting retainer structure 146 in a closed position. As shown, pivoting retainer structure 146 nests up against upper spring arm 120 and lower spring arm 122. With reference to FIG. 5C, this figure illustrates a top view of the nail clipper in the closed position. The dotted lines in this figure depict the contours of pivoting retainer structure 146 within the nail clipper. As illustrated, pivoting retainer structure 146 nests into one side of the nail clipper. On the other side of the nail clipper, are a stationary wall 152 and an active wall 154.

Figure 6A:
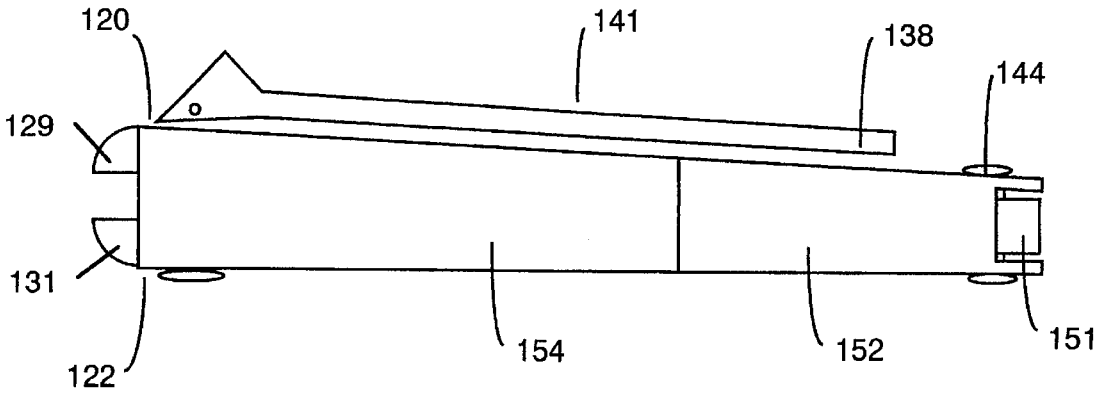
FIG. 6A is a side elevational view of the third embodiment with the lever in a resting position.

Turning now to FIG. 6A, this figure illustrates a side view of the third embodiment. Both stationary wall 152 and active wall 154 are rigid walls. The top of stationary wall 152 is coupled to upper spring arm 120, and the bottom of stationary wall 152 is coupled to lower spring arm 122. By contrast, only the bottom of active wall 154 is coupled to lower spring arm 122. The top of active wall 154 is not coupled to upper spring arm 120, thereby allowing upper spring arm 120 to move freely alongside active wall 154 when the nail clipper is actuated. Also shown in FIG. 6A is side cutting jaw 129 and side cutting jaw 131. A back portion of attachment sleeve 151 is also visible.

Figure 6B:
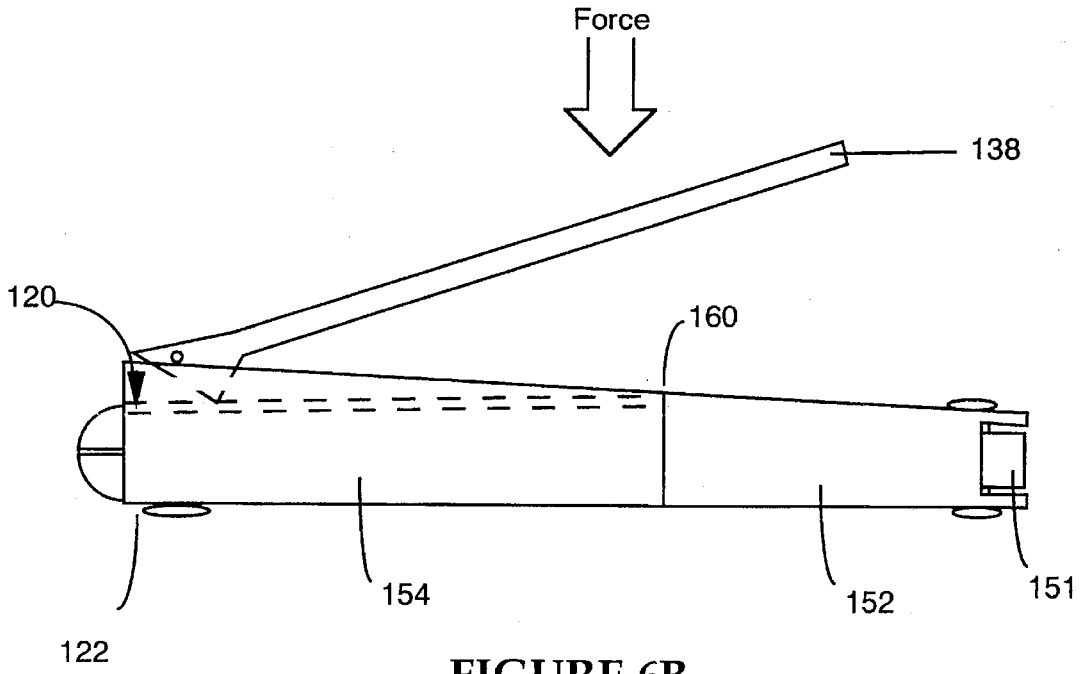
FIG. 6B is a side elevational view illustrating the result of applying force to the lever member.

FIG. 6B illustrates a side view of the third embodiment when force is applied to lever member 138. The outline of upper spring arm 120, situated behind active wall 154, is shown as a dotted line. Downward force applied to lever member 138 causes upper spring arm 120 to flex downward from flexing area 160. Thus, upper spring arm 120 flexes freely downward along active wall 154.

Figure 7A:
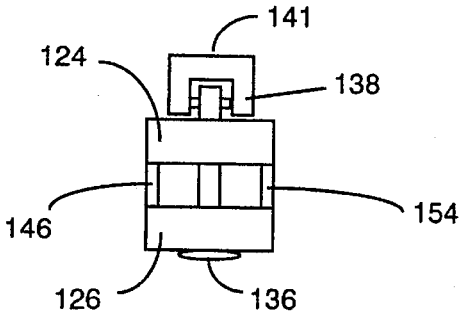
FIG. 7A is a front elevational view of the third embodiment.
Figure 7B:
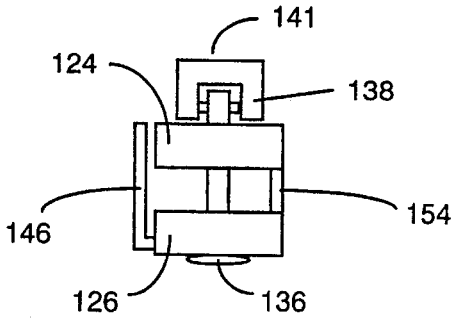
FIG. 7B is a front elevational view with the pivoting retaining structure slightly ajar.
Figure 7C:
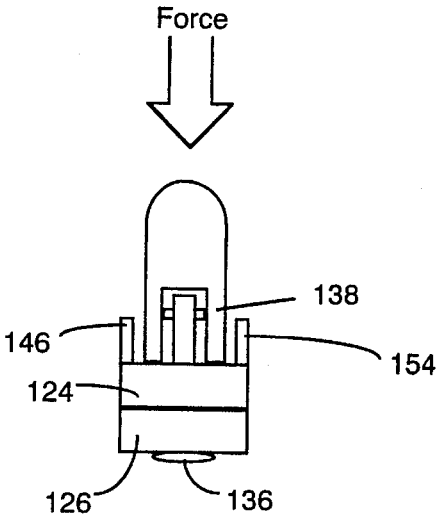
FIG. 7C is a front elevational view illustrating, the result of applying force to the lever member.

Turning now to FIG. 7A, this figure illustrates a frontal view of the third embodiment. Upper cutting jaw 124, lower cutting jaw 126, lever 138, resting surface 141, and center anchor pin 136 are noted. Portions of pivoting retainer structure 146 and active wall 154 are also visible between upper cutting jaw 124 and lower cutting jaw 126. FIG. 7B illustrates the preceding frontal view with the pivoting retainer structure 146 slightly ajar. FIG. 7C illustrates this frontal view following the application of force to lever member 138.

Figure 8A:
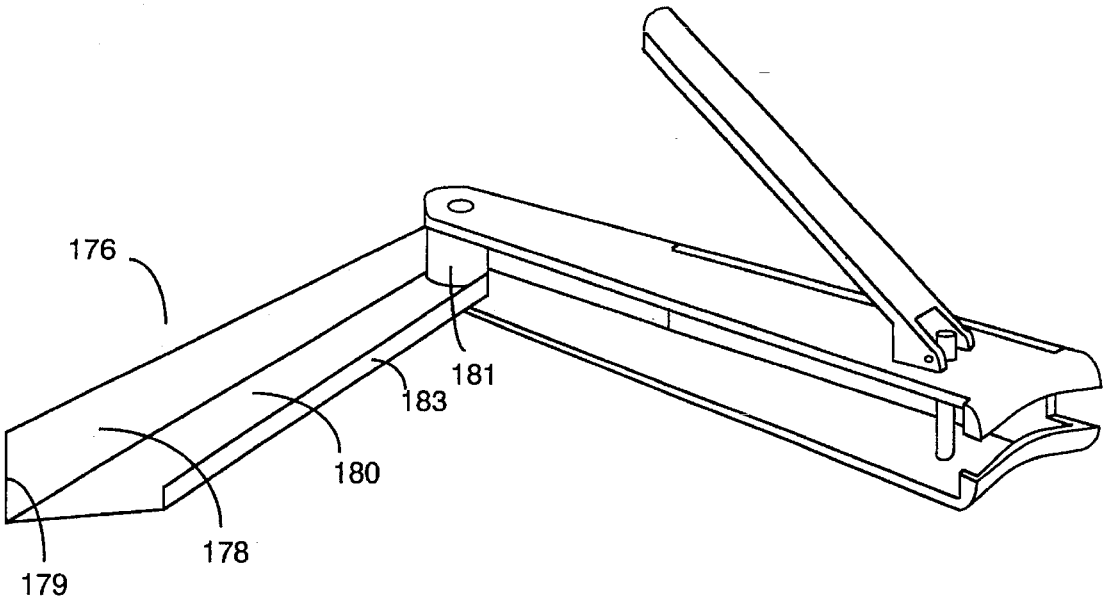
FIG. 8A is a perspective view of a fourth embodiment having a full tray structure.
Figure 8B:
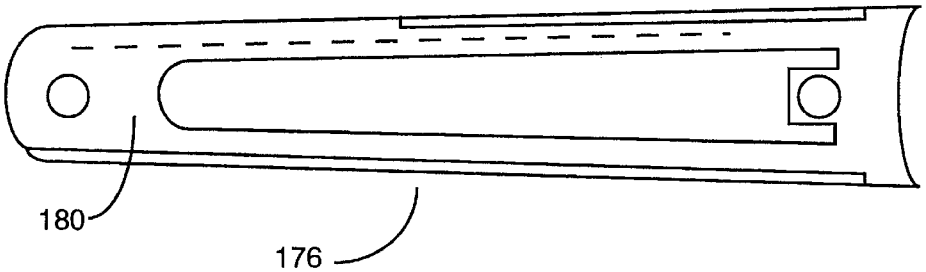
FIG. 8B is a top plan view of the the fourth embodiment.

With reference to FIG. 8A, a fourth embodiment of the present invention is shown. The fourth embodiment incorporates a pivoting retainer structure 176 with a full tray structure. In particular, pivoting retainer structure 176 comprises a side wall 178, a free end 179, a full floor 180, an attachment sleeve 181, and a tray wall 183. FIG. 8B is a top plan view of this embodiment. The dotted lines depict the contours of pivoting retainer structure 176 within the nail clipper. It will be apprecitated from FIGS. 8A and 8B that the pivoting retainer structure 176 serves as an internal clippings container.

Figure 9A:
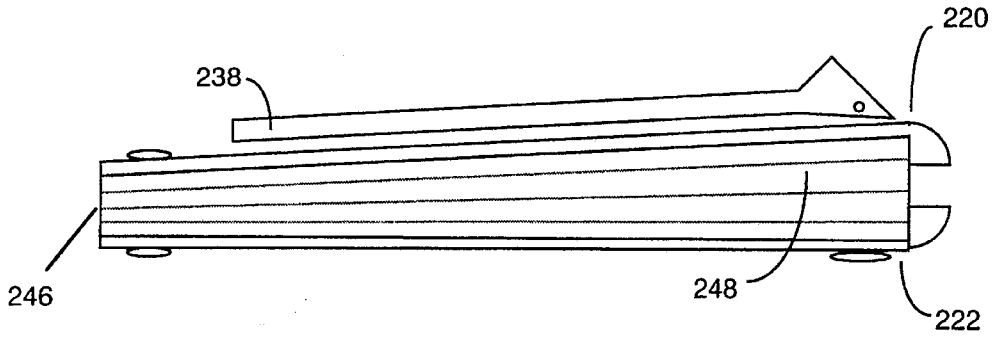
FIG. 9A is a side elevational view of a fifth embodiment having collapsible side walls.
Figure 9B:
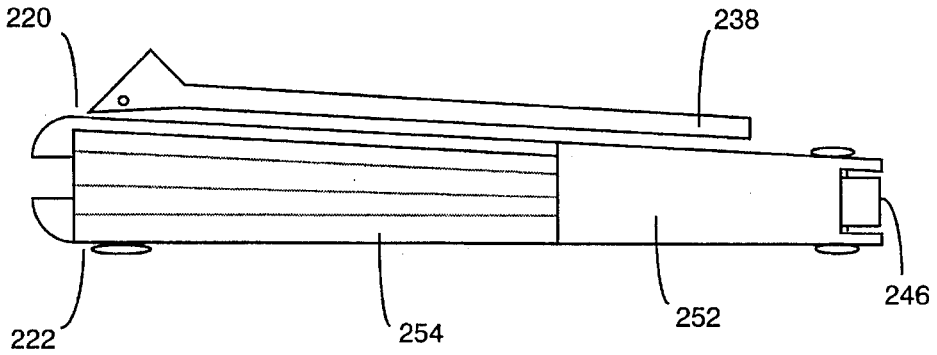
FIG. 9B is a side elevational view of the opposite side of the fifth embodiment.
Figure 9C:
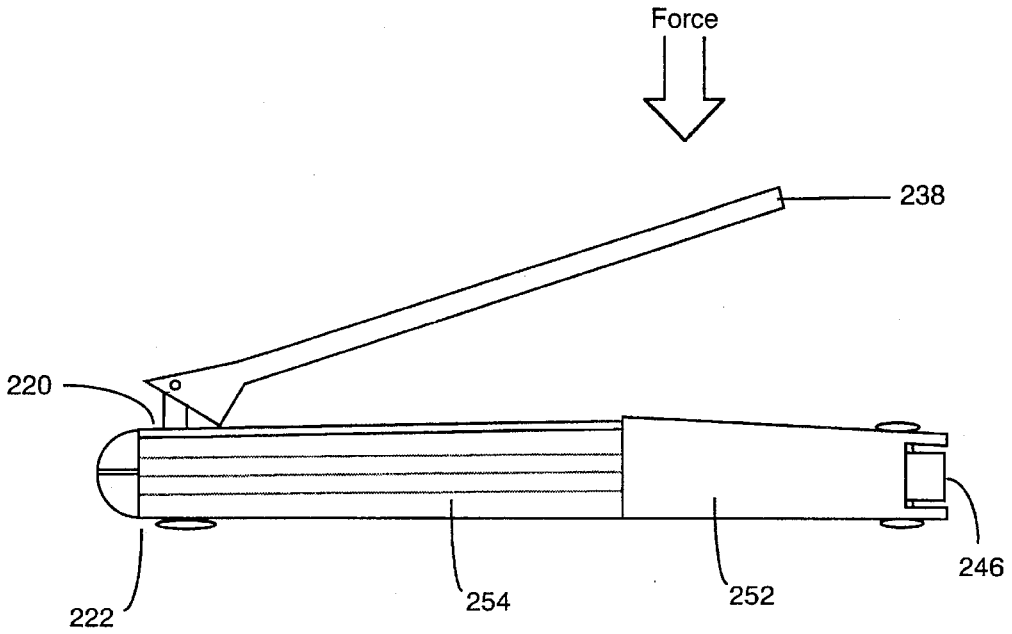
FIG. 9C is a side elevational view illustrating the result of applying force to the lever member.

Referring now to FIGS. 9A, 9B and 9C, a fifth embodiment of the present invention is illustrated. The structure of this embodiment is similar to the structure of the third embodiment with one major difference. Rather than use a rigid material for side walls, a collapsible material, such as plastic in an accordian configuration, is used. The resulting collapsible side walls are then disposed under the spring arms such that they collapse when the nail clipper is actuated.

FIG. 9A illustrates a side view of the fifth embodiment. The nail clipper includes an upper spring arm 220, a lower spring arm 222, and a lever member 238. A pivoting retainer structure 246 includes a side wall 248 comprised of a collapsible material. When pivoting retainer structure 246 is in the closed position, it nests into upper spring arm 220 and lower spring arm 222. In contrast to the third embodiment, this nesting places the top of side wall 248 under upper spring arm 220. Thus, when lever member 238 is utilized to cause upper spring arm 220 to move downward (not shown in this figure), side wall 248 is collapsed downward as well.

Referring now to FIG. 9B, this figure illustrates the opposite side of the fifth embodiment. An active wall 254 comprised of a collapsible material is coupled to both upper spring arm 220 and lower spring arm 222. A rigid stationary wall 252 is also coupled to upper spring arm 220 and lower spring arm 222. FIG. 9C depicts the result of applying downward force to lever member 238. Upper spring arm 220 flexes downward collapsing active wall 254.

Figure 10A:
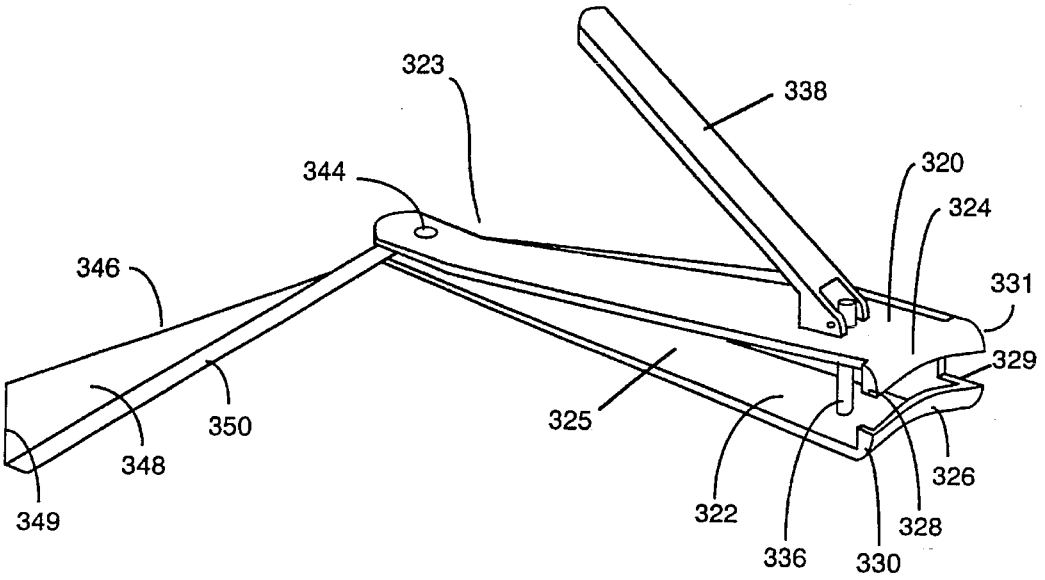
FIG. 10A is a perspective view of a sixth embodiment of the present invention with a pivoting retainer structure in an open position.

Turning to FIG. 10A, this figure illustrates a sixth embodiment of the present invention. Similar to the preceding embodiments, the nail clipper incorporates an upper spring arm 320 and a lower spring arm 322. While lower spring arm 322 is substantially planar in shape, upper spring arm 320 is kinked at kink area 323. Upper spring arm 320 and lower spring arm 322 are coupled together near kink area 323 with a cylindrical member 344. Cylindrical member 344 serves to dispose the ends of upper spring arm 320 and lower spring arm 322 a short distance apart.

Upper spring arm 320 and lower spring arm 322 are coupled together at a second end with a center anchor pin 336 which penetrates both spring arms. A lever member 338 is attached to center anchor pin 336. Upper spring arm 320 and lower spring arm 322 are disposed such that they define an internal cavity 325. Upper spring arm 320 terminates in an upper cutting jaw 324. Lower spring arm 322 terminates in a lower cutting jaw 326. The nail clipper further incorporates side cutting jaws 328, 329, 330, and 331. Each one of the aforementioned cutting jaws terminates in a separate sharp cutting edge.

Figure 10B:
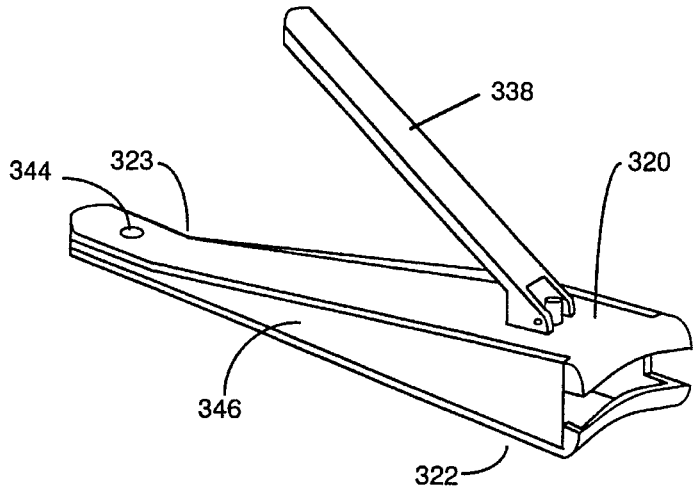
FIG. 10B is a perspective view of the sixth embodiment with the pivoting retainer structure closed.

In accordance with the present invention, the nail clipper utilizes a pivoting retainer structure 346. Pivoting retainer structure 346 incorporates a side wall 348, a free end 349, a partial floor 350, and an attachment ring 351 (not visible in this figure). As shown, side wall 348 ends prior to the termination of partial floor 350. Partial floor 350 passes through the narrow separation of upper spring arm 320 and lower spring arm 322 before connecting, via attachment ring 351, to cylindrical member 344. The amount of friction partial floor 350 encounters when pivoting between upper spring arm 320 and lower spring arm 322 will depend upon the dimensions of the narrow separation. Referring briefly to FIG. 10B, this figure illustrates the pivoting retainer structure 346 in a closed position nested against upper spring arm 320 and lower spring arm 322.

Figure 10C:
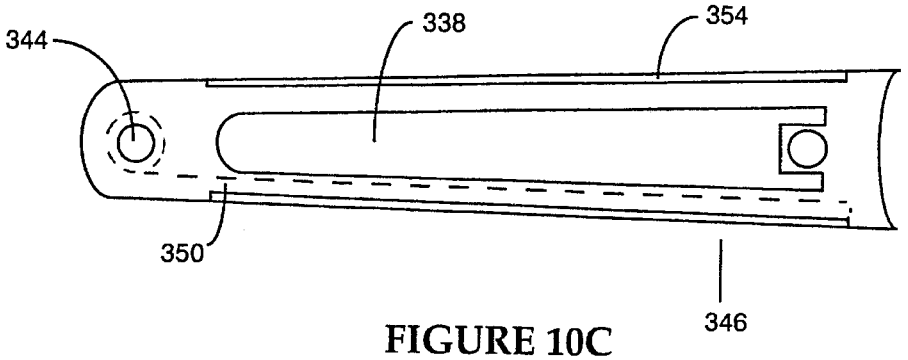
FIG. 10C is a top plan view of the sixth embodiment with the pivoting retainer structure closed.

With reference to FIG. 10C, this figure illustrates a top view of the sixth embodiment with pivoting retainer structure 346 in the closed position. The dotted lines indicated the contours of pivoting retainer structure 346 within the nail clipper. It will be appreciated from this figure, that unlike the previous embodiments, the sixth embodiment incorporates a single active wall 354. The top of single active wall 354 is visible in this figure.

Figure 11A:
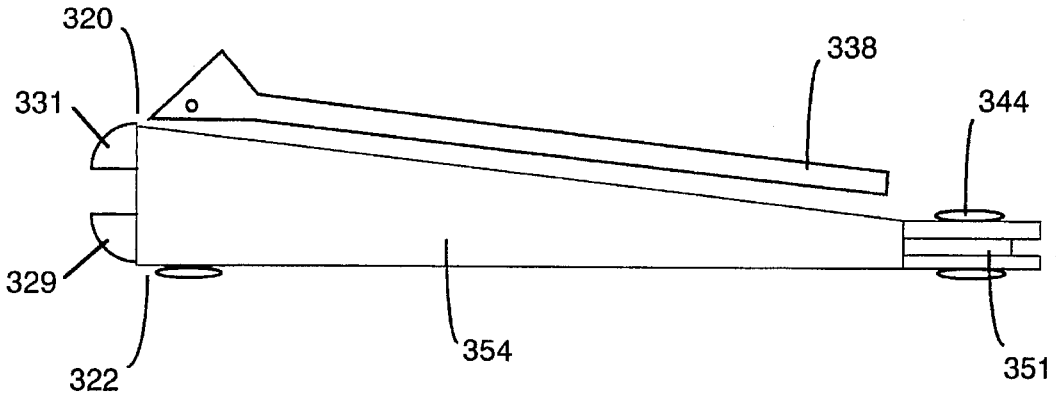
FIG. 11A is a side elevational view of the sixth embodiment.

Referring to FIG. 11A, this figure illustrates a side view of the sixth embodiment. In particular, the side of the nail clipper with single active wall 354 is shown. The bottom of single active wall 354 is coupled to lower spring arm 322. The top of single active wall 354 is not connected to upper spring arm 320. Also visible in FIG. 11A is side cutting jaw 329, side cutting jaw 331, and a portion of attachment ring 351.

Figure 11B:
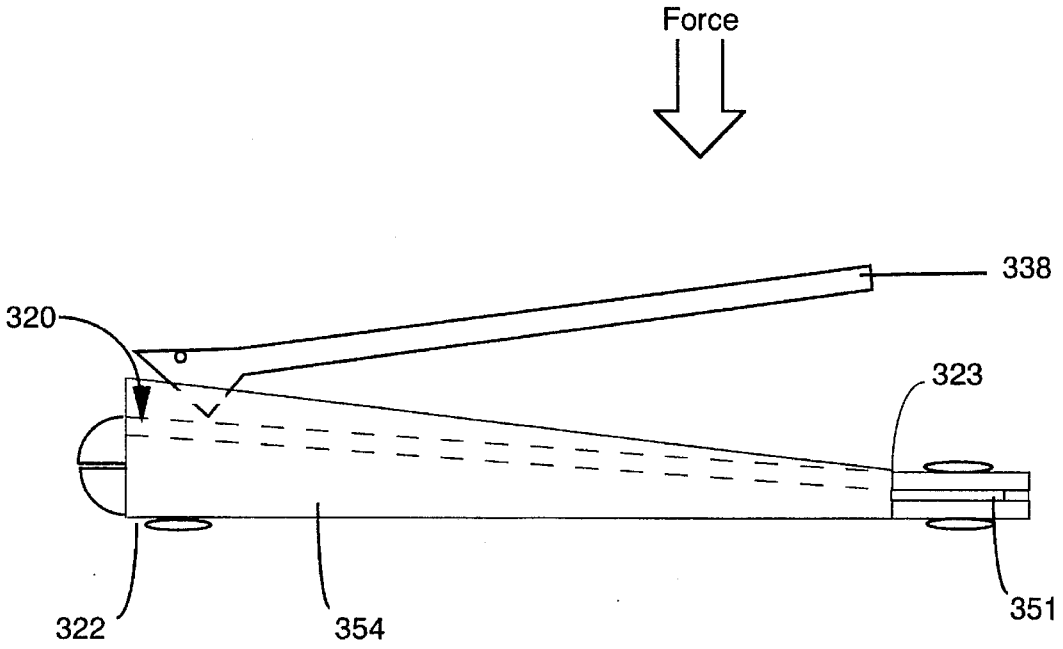
FIG. 11B is a side elevational view illustrating the result of applying force to the lever member.

With reference to FIG. 11B, a side view of the sixth embodiment when force is applied to lever member 338 is shown. The outline of upper spring arm 320, situated behind single active wall 354, is shown as a dotted line. As illustrated, upper spring arm 320 flexes flow, kinked area 323. Single active wall 354 allows upper spring arm 320 to flex freely, while nevertheless, serving as a wall to prevent clippings from leaving the internal cavity 325 of the nail clipper.

Figure 12A:
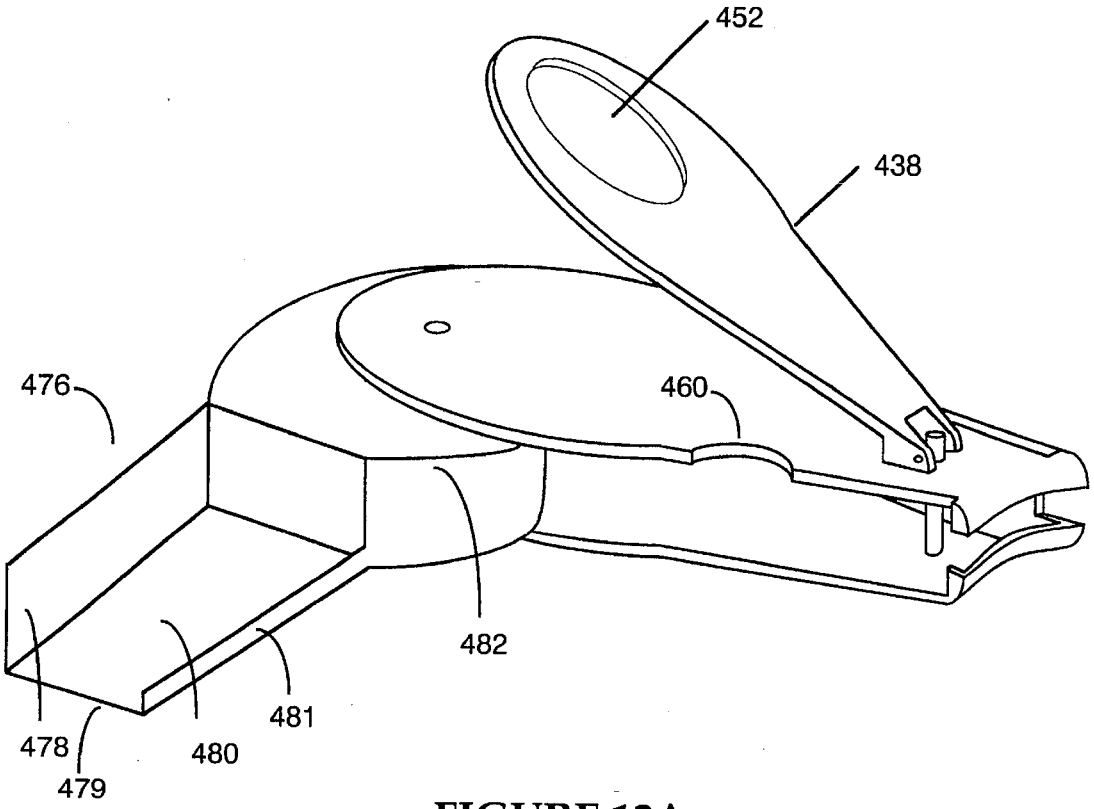
FIG. 12A is a perspective view of a seventh embodiment of the present invention with a solid rear portion for the pivoting retainer structure.
Figure 12B:
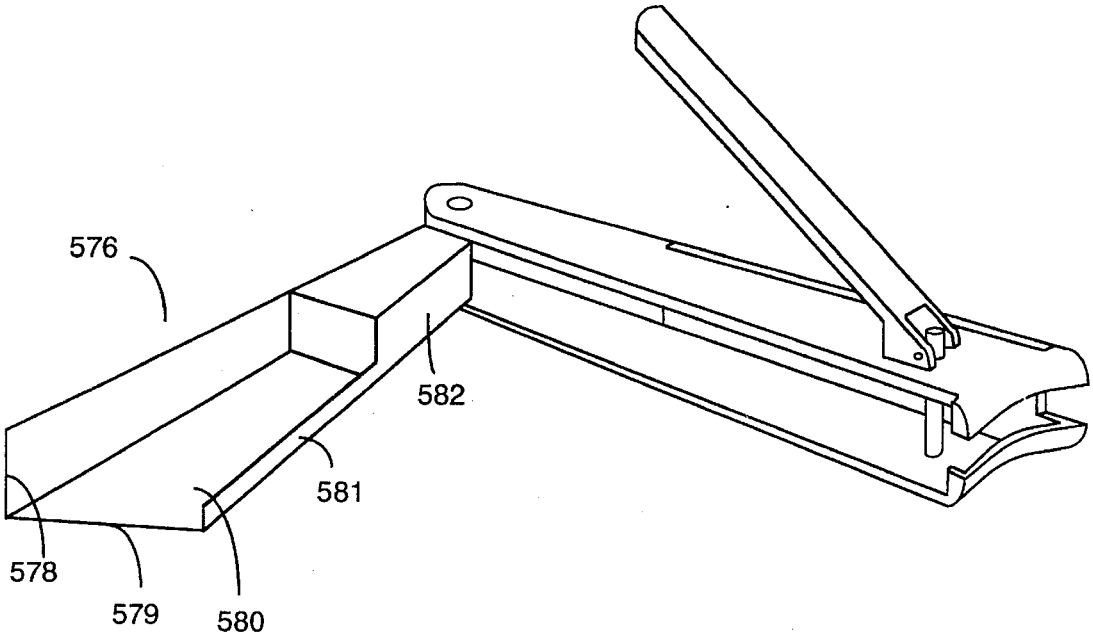
FIG. 12B is a perspective view of an eighth embodiment also with a solid rear portion for the pivoting retainer structure.

Turning now to FIGS. 12A and 12B, these figures illustrate seventh and eighth embodiments. In each of these embodiments, the rear portions of the pivoting retainer structures are made of solid material. Thus, in a FIG. 12A, a pivoting retainer structure 476 comprises a side wall 478, a free end 479, a floor 480, a tray wall 481, and a solid rear portion 482. Similarly, as depicted in FIG. 12B, a pivoting retainer structure 576 incorporates a side wall 578, a free end 579, a floor 580, a tray wall 581, and a solid rear portion 582. With pivoting retainer structures 476 and 576 comprised of solid material, the solid rear portions 482 and 582 would be comprised of solid material. These solid rear portions would stabilize and secure the entire structure by fitting firmly between upper and lower spring arms. In addition, it is envisioned that solid rear portions 482 and 582 would terminate just prior to upper spring arm flexing areas, thereby creating a barrier or wall which would keep the retained clippings in the forward portions of the pivoting retainer structures. It should be noted that the pivoting retainer structures 476 and 576 with solid rear portions may alternatively be constructed with partial floors and no tray walls in accordance with FIGS. 1A and 5A.

The clipper shown in FIG. 12A additionally incorporates an alternative construction for its lever. In particular, as shown, a lever 438 incorporates a finger acceptance hole 452 which fully pierces or perforates lever 438. The dimensions and shape of finger acceptance hole 452 are advantageously chosen to accomodate the placement of a finger, a thumb for example, on top of it without allowing the finger to fully push through finger acceptance hole 452. In this way cavity, finger acceptance hole 452 facilitates the steady application of force to lever 438. It is envisioned that similar finger acceptance holes could be placed on the levers in the previously described clippers. For example, a similar finger acceptance hole 452 could be substituted for the dimple 42 shown in FIG. 1A. It will also be appreciated from FIG. 12A that the clipper shown utilizes a single indentation 460, a design feature which similarly could be placed on any of the previously described clippers.

While the present invention has been particularly described with reference to FIGS. 1A through 12B, it should be understood that the figures are for illustration only and should not be taken as limitations upon the invention. It is further contemplated that many changes and modifications may be made to the invention, by one of ordinary skill in the art, without departing from the spirit and scope of the invention as disclosed herein. For example, the preceding nail clippers could be modified to each include two pivoting retainer structures, one on each side of the clipper. Alternatively, it is contemplated that the pivoting retainer structure comprise only an attachment ring and a side wall, without a partial or complete floor. In addition, the shape of the partial or complete floor need not follow the outer contours of the clipper.

I claim:

1. A nail clipper comprising:

a first spring arm comprising a first end, a second end, a first side, and a second side;

a second spring arm having a first end, a second end, a first side, and a second side;

a first cutting jaw coupled to said first end of said first spring arm;

a second cutting jaw coupled to said first end of said second spring arm;

a lever member, coupled to said first end of said first spring arm and said first end of said second spring arm, for resiliently moving said first cutting jaw toward said second cutting jaw;

an active wall having a top and a bottom, said bottom of said active wall coupled to said first side of said second spring arm;

a stationary wall having a top and a bottom, said top of said stationary wall coupled to said first side of said first spring arm, said bottom of said stationary wall coupled to said first side of said second spring arm;

a cylindrical member coupled to said second end of said first spring arm and said second end of said second spring arm;

a clipping retainer means for selectively retaining a nail clipping, said clipping retainer means coupled to said cylindrical member such that said clipping retainer means is radially pivotable about said cylindrical member and nests into said second side of said first spring arm and said second side of said second spring arm.

2. The nail clipper as provided in claim 1, wherein, said first spring arm is substantially teardrop in shape such that said first end of said first spring arm comprises a narrow area and said second end of said first spring arm comprises an ovoid area;

said second spring arm is substantially teardrop in shape such that said first end of said second spring arm comprises a narrow area and said second end of said second spring arm comprises an ovoid area.

3. The nail clipper as provided in claim 2, wherein, said lever member is substantially teardrop in shape such that a first end of said lever member comprises a narrow area and a second end of said lever member comprises an ovoid area, said ovoid area having a dimple disposed within it.

4. The nail clipper as provided in claim 2, wherein, said lever member is substantially teardrop in shape such that a first end of said lever member comprises a narrow area and a second end of said lever member comprises an ovoid area, said ovoid area having a finger acceptance hole disposed within it.

5. The nail clipper as provided in claim 1, wherein, said first cutting jaw has a first side and a second side;

a first side cutting jaw is coupled approximately perpendicular to said first side of said first cutting jaw;

a second side cutting jaw is coupled approximately perpendicular to said second side of said first cutting jaw.

6. The nail clipper as provided in claim 5, wherein, said second cutting jaw has a first side and a second side;

a third side cutting jaw is coupled approximately perpendicular to said first side of said second cutting jaw;

a fourth side cutting jaw is coupled approximately perpendicular to said second side of said second cutting jaw.

7. The nail clipper as provided in claim 1, wherein, a first indent is disposed upon said second side of said first spring arm.

8. The nail clipper as provided in claim 1, wherein, said clipping retainer means comprises an attachment sleeve and a side wall, such that said attachment sleeve is coupled to said cylindrical member and said side wall such that, said side wall abuts against said second side of said first spring arm when said clipping retainer means is nested into said second side of said first spring arm and said second side of said second spring arm.

9. The nail clipper as provided in claim 8, wherein said clipping retainer means further includes:

a floor having a first end and a second end, said first end coupled to said side wall such that said floor is substantially orthoganal to said side wall.

10. The nail clipper as provided in claim 9, wherein said retainer means further includes:

a tray wall, coupled to said second end of said floor substantially orthoganal to said floor.

11. The nail clipper as provided in claim 8, wherein, said active wall comprises a resiliently collapsible material; and said side wall comprises a resiliently collapsible material.

12. A nail clipper comprising:

a first spring arm comprising a first end, a second end, a first side, and a second side;

a second spring arm having a first end, a second end, a first side, and a second side;

a first cutting jaw coupled to said first end of said first spring arm;

a second cutting jaw coupled to said first end of said second spring arm;

a lever member, coupled to said first end of said first spring arm and said first end of said second spring arm, for resiliently moving said first cutting jaw toward said second cutting jaw;

coupling means coupled to said first spring arm and said second spring arm, wherein said first spring arm is thereby disposed toward said second spring arm such that a cavity is formed between said first spring arm and said second spring arm;

clipping retainer means for selectively retaining a nail clipping within said cavity, said clipping retainer means coupled to said coupling means such that said retainer means is radially pivotable about said coupling means; wherein, said clipping retainer means includes an attachment ring and a side wall;

said coupling means comprises a cylindrical member;

further wherein, said attachment ring is coupled to said cylindrical member and said side wall such that said side wall abuts against said second side of said first spring arm when said clipping retainer means is nested into said second side of said first spring arm and said second side of said second spring arm; and said clipping retainer means further includes a floor having a first end and a second end, said first end coupled to said side wall such that said floor is substantially orthoganal to said side wall.

13. The nail clipper as provided in claim 12, wherein said retainer means further includes:

a tray wall, coupled to said second end of said floor substantially orthoganal to said floor.

14. A nail clipper comprising:

a first spring arm comprising a first end, a second end, a first side, and a second side;

a second spring arm having a first end, a second end, a first side, and a second side;

a first cutting jaw coupled to said first end of said first spring arm;

a second cutting jaw coupled to said first end of said second spring arm;

a lever member, coupled to said first end of said first spring arm and said first end of said second spring arm, for resiliently moving said first cutting jaw toward said second cutting jaw;

coupling means coupled to said first spring arm and said second spring arm, wherein said first spring arm is thereby disposed toward said second spring arm such that a cavity is formed between said first spring arm and said second spring arm;

clipping retainer means for selectively retaining a nail clipping within said cavity, said clipping retainer means coupled to said coupling means such that said retainer means is radially pivotable about said coupling means; wherein, a first indent is disposed upon said second side of said first spring arm;

a second indent is disposed upon said second side of said second spring arm.

15. A nail clipper comprising:

a first spring arm comprising a first end, a second end, a first side, and a second side;

a second spring arm having a first end, a second end, a first side, and a second side;

a first cutting jaw coupled to said first end of said first spring arm;

a second cutting jaw coupled to said first end of said second spring arm;

a lever member, coupled to said first end of said first spring arm and said first end of said second spring arm, for resiliently moving said first cutting jaw toward said second cutting jaw;

coupling means coupled to said first spring arm and said second spring arm, wherein said first spring arm is thereby disposed toward said second spring arm such that a cavity is formed between said first spring arm and said second spring arm;

clipping retainer means for selectively retaining a nail clipping within said cavity, said clipping retainer means coupled to said coupling means such that said retainer means is radially pivotable about said coupling means;

wherein said lever member comprises a first side and a second side, said lever member perforated from said first side to said second side, said perforation thereby defining a finger acceptance hole.

16. A nail clipper comprising:

a first spring arm having a top planar surface, a bottom planar surface, a first end, and a second end;

a second spring arm having a top planar surface, a bottom planar surface, a first end and a second end;

a first cutting jaw coupled to said first end of said first spring arm;

a second cutting jaw coupled to said first end of said second spring arm;

a lever member, coupled to said first end of said first spring arm and said first end of said second spring arm, for resiliently moving said first cutting jaw toward said second cutting jaw;

coupling means coupled to said bottom planar surface of said first spring arm and said top planar surface of said second spring arm, wherein said bottom planar surface of said first spring arm is thereby disposed toward said top planar surface of said second spring arm such that a cavity is formed between said bottom planar surface of said first spring arm and said top planar surface of said second spring arm;

clipping retainer means for selectively retaining a nail clipping within said cavity, said clipping retainer means coupled to said coupling means such that said retainer means is radially pivotable about said coupling means;

wherein said clipping retainer means includes a side wall and a floor, said floor approximately orthoganal to said side wall.

17. A nail clipper comprising:

a first spring arm having a top planar surface, a bottom planar surface, a first end, and a second end;

a second spring arm having a top planar surface, a bottom planar surface, a first end and a second end;

a first cutting jaw coupled to said first end of said first spring arm;

a second cutting jaw coupled to said first end of said second spring arm;

a lever member, coupled to said first end of said first spring arm and said first end of said second spring arm, for resiliently moving said first cutting jaw toward said second cutting jaw;

coupling means coupled to said bottom planar surface of said first spring arm and said top planar surface of said second spring arm, wherein said bottom planar surface of said first spring arm is thereby disposed toward said top planar surface of said second spring arm such that a cavity is formed between said bottom planar surface of said first spring arm and said top planar surface of said second spring arm;

clipping retainer means for selectively retaining a nail clipping within said cavity, said clipping retainer means coupled to said coupling means such that said retainer means is radially pivotable about said coupling means;

wherein said clipping retainer means pivots radially about said coupling means, thereby defining a plane through its sweep from a first position to a second position, which is approximately parallel to said top planar surface of said second spring arm.

18. A nail clipper comprising:

a first spring arm having a top planar surface, a bottom planar surface, a first end, and a second end;

a second spring arm having a top planar surface, a bottom planar surface, a first end and a second end;

a first cutting jaw coupled to said first end of said first spring arm;

a second cutting jaw coupled to said first end of said second spring arm;

a lever member, coupled to said first end of said first spring arm and said first end of said second spring arm, for resiliently moving said first cutting jaw toward said second cutting jaw;

coupling means coupled to said bottom planar surface of said first spring arm and said top planar surface of said second spring arm, wherein said bottom planar surface of said first spring arm is thereby disposed toward said top planar surface of said second spring arm such that a cavity is formed between said bottom planar surface of said first spring arm and said top planar surface of said second spring arm;

clipping retainer means for selectively retaining a nail clipping within said cavity, said clipping retainer means coupled to said coupling means such that said retainer means is radially pivotable about said coupling means;

wherein said coupling means comprises a cylindrical member coupled to said second end of said first spring arm, approximately perpendicular to said bottom planar surface of said first spring arm, and further coupled to said second end of said second spring arm, approximately perpendicular to said top planar surface of said second spring arm, such that said clipping retainer means is radially pivotable about said cylindrical member.

19. The nail clipper as provided in claim 18, wherein, said clipping retainer means comprises a free end and a coupling end, said coupling end coupled to said cylindrical member, such that said clipping retainer means can be radially pivoted from at least a first closed position wherein a nail clipping is retained within said cavity, to a second open position wherein said nail clipping is selectively emptied from said cavity;

wherein said free end of said clipping retainer means is at a first distance from said first cutting jaw when said clipping retainer means is in said first closed position; and said free end of said clipping retainer means is at a second distance from said first cutting jaw when said clipping retainer means is in said second open position, said second distance greater than said first distance.

20. A nail clipper comprising:

a first spring arm comprising a first end, a second end, a first side, and a second side;

a second spring arm having a first end, a second end, a first side, and a second side;

a first cutting jaw coupled to said first end of said first spring arm;

a second cutting jaw coupled to said first end of said second spring arm;

a lever member, coupled to said first end of said first spring arm and said first end of said second spring arm, for resiliently moving said first cutting jaw toward said second cutting jaw;

coupling means coupled to said first spring arm and said second spring arm, wherein said first spring arm is thereby disposed toward said second spring arm such that a cavity is formed between said first spring arm and said second spring arm;

wherein, said first cutting jaw has a first side and a second side;

said second cutting jaw has a first side and a second side;

a first side cutting jaw is coupled substantially perpendicular to said first side of said first cutting jaw;

a second side cutting jaw is coupled substantially perpendicular to said second side of said first cutting jaw;

a third side cutting jaw is coupled substantially perpendicular to said first side of said second cutting jaw;

a fourth side cutting jaw is coupled substantially perpendicular to said second side of said second cutting jaw.

* * * * *